US008605078B2

(12) United States Patent
Baek et al.

(10) Patent No.: US 8,605,078 B2
(45) Date of Patent: Dec. 10, 2013

(54) SOURCE DRIVER AND DISPLAY DEVICE HAVING THE SAME

(75) Inventors: Jong Hak Baek, Seoul (KR); Yoon Kyung Choi, Yongin-si (KR); Oh-Kyong Kwon, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 972 days.

(21) Appl. No.: 12/631,406

(22) Filed: Dec. 4, 2009

(65) Prior Publication Data

US 2010/0141639 A1 Jun. 10, 2010

(30) Foreign Application Priority Data

Dec. 5, 2008 (KR) ..... 10-2008-0123252

(51) Int. Cl.
*G09G 5/00* (2006.01)

(52) U.S. Cl.
USPC ..... 345/213

(58) Field of Classification Search
None
See application file for complete search history.

(56) References Cited

U.S. PATENT DOCUMENTS 7,180,497 B2 2/2007 Lee et al.
2006/0274013 A1* 12/2006 Lin et al. ..... 345/98
2006/0274028 A1 12/2006 Harada
2007/0146187 A1* 6/2007 Chia ..... 341/144
2007/0182667 A1* 8/2007 Choi ..... 345/55

FOREIGN PATENT DOCUMENTS

JP 2003-208135 7/2003
JP 2006-337805 12/2006
JP 2008-065294 3/2008
KR 1020030061553 7/2003
KR 1020070098866 10/2007

OTHER PUBLICATIONS

English Abstract for Publication No. 1020030061553.
English Absract for Publication No. 2003-208135.
English Abstract for Publication No. 2000-337805.
English Abstract for Publication No. 1020070098866.
English Abstract for Publication No. 2008-065294.

* cited by examiner

*Primary Examiner* — Christopher R Lamb
(74) *Attorney, Agent, or Firm* — F. Chau & Associates, LLC

(57) ABSTRACT

A source driver and a display device having the same are provided. The source driver shares several outputs by using a time division method and has an analog voltage stored in a buffer supplied to each data line multiple times during a horizontal scanning interval. Accordingly, by supplying an analog voltage to a data line a first time in a first activation interval and supplying an analog voltage to a data line a second time in a second activation interval, a target voltage of each pixel may be achieved quickly and accurately.

18 Claims, 5 Drawing Sheets

SOURCE DRIVER AND DISPLAY DEVICE HAVING THE SAME

CROSS-REFERENCE TO RELATED APPLICATION

This application claims priority under 35 U.S.C. §119 to Korean Patent Application No. 10-2008-0123252, filed on 5 Dec. 2008, in the Korean Intellectual Property Office, the disclosure of which is incorporated herein in its entirety by reference.

BACKGROUND

1. Technical Field

The present invention relates to a display device, and more particularly, to a source driver and a display device having the same.

2. Discussion of the Related Art

A source driver called a data line driver converts a digital signal corresponding to image data into an analog voltage and displays the image data by supplying the converted analog voltage to each pixel of a display panel.

FIG. 1 is a schematic diagram illustrating a display panel and an equivalent circuit of each pixel thereof. The display panel includes a plurality of data lines Si, Si+1, Si+2 and Si+3, a plurality of gate lines, Gj, Gj+1 and Gj+2, and a plurality of pixels formed at a crossover point of the each data line and the each gate line. Each pixel may include a transistor and a pixel capacitor and may write data by charging analog voltage corresponding to a gray level of an image to display to the pixel capacitor. Accordingly, a transistor may be turned on by applying a voltage to a gate line, and data may be written by supplying a constant voltage to a data line.

As shown in FIG. 1, an equivalent circuit of each pixel as seen from a source driver may be embodied as an equivalent resistance $R_{DL}$ of a data line, a parasitic capacitor $C_{DL}$ of a data line, an on-resistor $R_{TFT}$ of a transistor, and a capacitor Cps of a pixel. However, when the transistor is embodied as an amorphous silicon TFT (thin-film transistor), the capacitor Cps of a pixel may not be charged with a target voltage while a voltage is supplied since an on-resistor of the transistor is very great.

SUMMARY

The present general inventive concept provides a source driver capable of minimizing an error of voltage charged in each pixel and capable of charging each pixel with a voltage corresponding to a write data accurately, and a display device having the same.

An exemplary embodiment of the present invention is directed to a source driver, including a buffer for buffering an analog voltage and a switching circuit connected between an output terminal of the buffer and a data line and switching to supply an output voltage of the buffer to the data line multiple times in response to a control signal during one horizontal scanning interval.

The source driver may further include a logic gate generating the control signal for supplying the output voltage of the buffer to the data line multiple times during the horizontal scanning interval. The output voltage of the buffer is supplied to the data line twice in response to the control signal during the horizontal scanning interval, and the control signal may include a first activation interval and a second activation interval. The first activation interval and the second activation interval are different from each other. The second activation interval may be shorter than the first activation interval. The control signal may further include a non-overlap interval for minimizing noise produced by an analog voltage supplied to another channel.

Additionally, a display device according to an exemplary embodiment of the present invention may include a source driver, a timing controller generating a control signal so that an analog voltage output from the source driver may be supplied to one of a plurality of data lines, and a display panel displaying an image signal by receiving the analog voltage from the source driver. The source driver may include a buffer for buffering an analog voltage and a switching circuit connected between an output terminal of the buffer and a data line for supplying an output voltage of the buffer to the data line multiple times during a horizontal scanning interval in response to a control signal.

The output voltage of the buffer is supplied to the data line twice during the horizontal scanning interval in response to the control signal, and the control signal may include a first activation interval and a second activation interval.

BRIEF DESCRIPTION OF THE DRAWINGS

These and/or other aspects of the present general inventive concept will become apparent and more readily appreciated from the following description of the exemplary embodiments, taken in conjunction with the accompanying drawings of which.

DETAILED DESCRIPTION OF THE EXEMPLARY EMBODIMENTS

Figure 1:
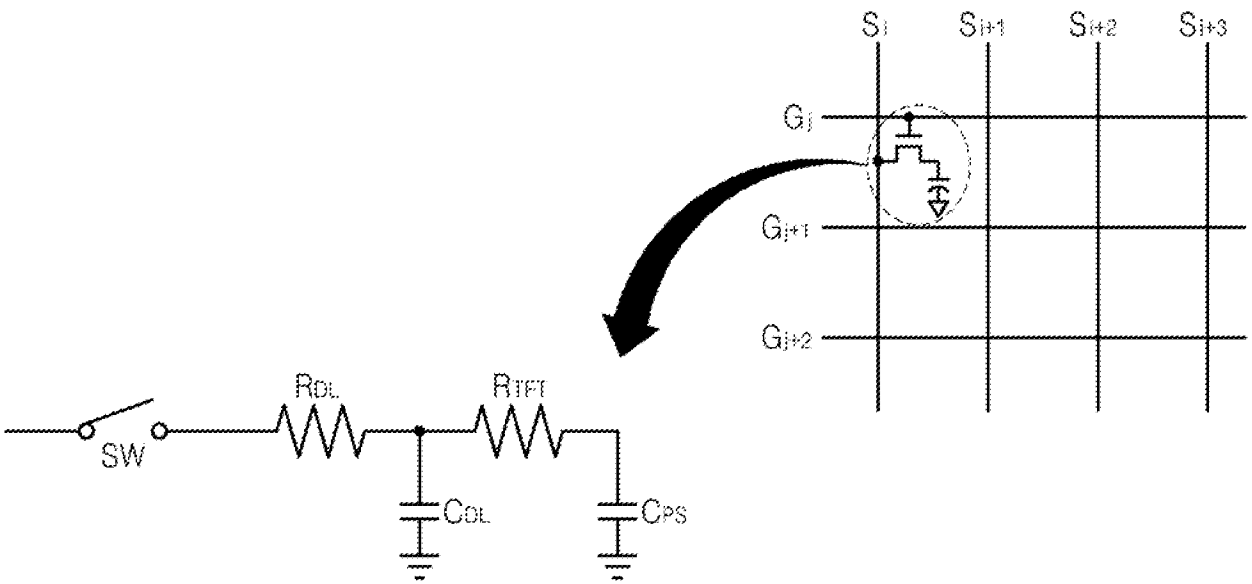
FIG. 1 is a drawing illustrating a schematic composition of a display panel and an equivalent circuit of each pixel.

Reference will now be made in detail to exemplary embodiments of the present general inventive concept and the accompanying drawings, wherein like reference numerals may refer to the like elements throughout.

Figure 2:
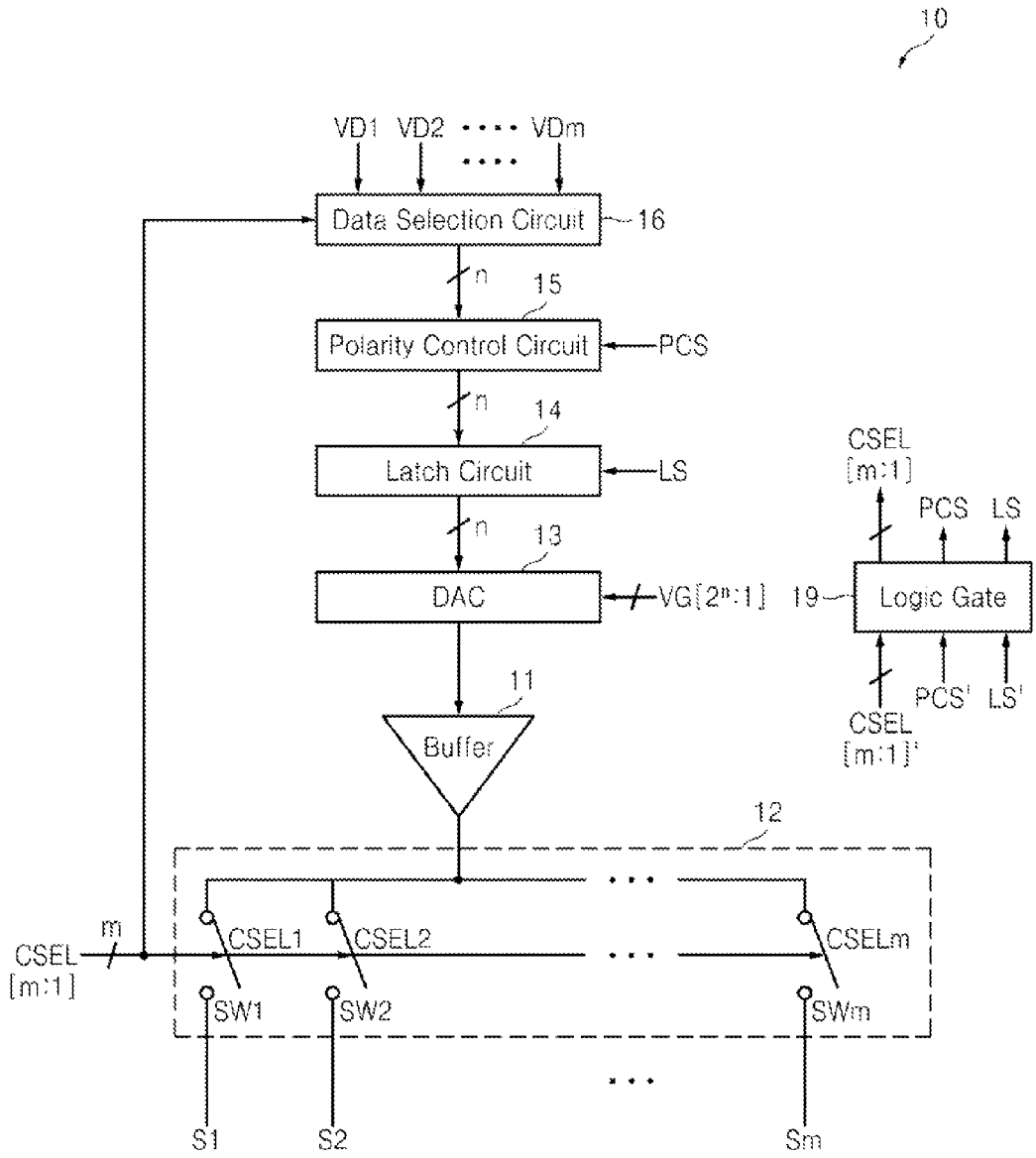
FIG. 2 is a block diagram of a source driver according to an exemplary embodiment of the present invention.

FIG. 2 is a block diagram of a source driver 10 according to an exemplary embodiment of the present invention. Referring to FIGS. 1 and 2, the source driver 10 may include a buffer 11 and a switching circuit 12. The buffer 11 may buffer a plurality of analog voltages corresponding to each of a plurality of digital image data VD1, VD2, . . . , VDm.

The switching circuit 12 may include a plurality of switches SW1 to SWm, where m is a positive integer. The plurality of switches SW1 to SWm are connected to an output terminal of the buffer 11 and a corresponding data line among a plurality of data lines S1, S2, . . . , Sm. The analog voltages may be supplied to each data line multiple times in response to a plurality of channel select signals CSEL[m:1] in a horizontal scanning interval.

The source driver 10 may further include a data selection circuit 16, a polarity control circuit 15, a latch circuit 14, a digital to analog converter (DAC) 13, and a logic gate 19. The logic gate 19 may receive channel selection signals CSEL[m:1]' and a plurality of control signals PCS' and LS' from an external controller, e.g., a timing controller, adjust a timing or a level of received signals to suit an environment of the source driver 10, and output adjusted signals CSEL[m:1], a PCS and a LS.

The data selection circuit 16 may receive a plurality of digital image data VD1 to VDm, and select and output one of the plurality of digital image data VD1 to VDm in response to the plurality of the channel selection signals CSEL1 to CSELm. For example, the plurality of the data image data VD1 to VDm may respectively be embodied as n bits, where n is a positive integer. The polarity control circuit 15 may selectively inverts output data from the data selection circuit 16 in response to the polarity control signal PCS and may output the inverted data.

The latch circuit 14 may receive and store an output data of the polarity control circuit 15 and output an output data of the polarity control circuit 15 to the DAC 13 in response to the latch signal LS. The DAC 13 receives a plurality of analog voltages VG[$2^n$:1] occurring based on the bit number of the digital image data VD1, VD2, . . . , VDm, and selects and outputs an analog voltage corresponding to an output data of the latch circuit 14 among the plurality of the analog voltages VG[$2^n$:1]. For example, when the digital image data is n bit, the number of the plurality of the analog voltages VG[$2^n$:1] is $2^n$, and the DAC 13 selects and outputs an analog voltage corresponding to an output data of the latch circuit 14 among the $2^n$ analog voltages VG[$2^n$:1].

Analog voltages output from the DAC 13 are buffered by the buffer 11, and the plurality of switches SW1 to SWm may output an analog voltage buffered by the buffer 11 to one of a plurality of data lines S1, S2, . . . Sm in response to the plurality of channel select signals CSEL1 to CSELm.

In detail, the plurality of channel selection signals CSEL1 to CSELm may control the switching circuit 12 and the data selection circuit 16 so that an analog voltage may be supplied to each data line multiple times during a horizontal scanning interval. According to some exemplary embodiments, the source driver 10 may be embodied so that an analog voltage may be supplied to each data line twice during a horizontal scanning interval.

For example, the channel selection signals CSEL1 to CSELm may include two activation intervals, e.g., an interval having a high level, and a deactivation interval, e.g., an interval having a low level, between the two activation intervals in a horizontal scanning interval, respectively. Accordingly, the switching circuit 12 may control so that an analog voltage may be supplied to each data line in the activation interval. For example, when an analog voltage is supplied to a data line in the first activation interval, most of the voltage (or charge) supplied due to large resistance of a transistor on-resistor $R_{TFT}$ may be charged to a parasitic capacitor $C_{DL}$ of a data line. Here, an amount of a voltage charged to the parasitic capacitor $C_{DL}$ is almost equal to a target voltage which is to be charged to a pixel capacitor $C_{PS}$.

In addition, a magnitude of a voltage charged to the pixel capacitor $C_{PS}$ may be increased since charge sharing occurs between a parasitic capacitor $C_{DL}$ and a pixel capacitor $C_{PS}$ in a deactivation interval. In this case, since a value, e.g., 30 pF, of a parasitic capacitor $C_{DL}$ of a data line is much greater than a value, e.g., 0.3 pF, of a pixel capacitor Cps, a voltage of a pixel capacitor Cps may be charged substantially as much as a voltage of a parasitic capacitor $C_{DL}$ by charge sharing. Thereafter, when an analog voltage is supplied to the data line again in the second activation interval, a voltage of the pixel capacitor Cps is already charged to a level close to a target voltage, so that a charged voltage in the pixel capacitor Cps may access to a demanding target voltage more quickly and accurately.

Figure 3:
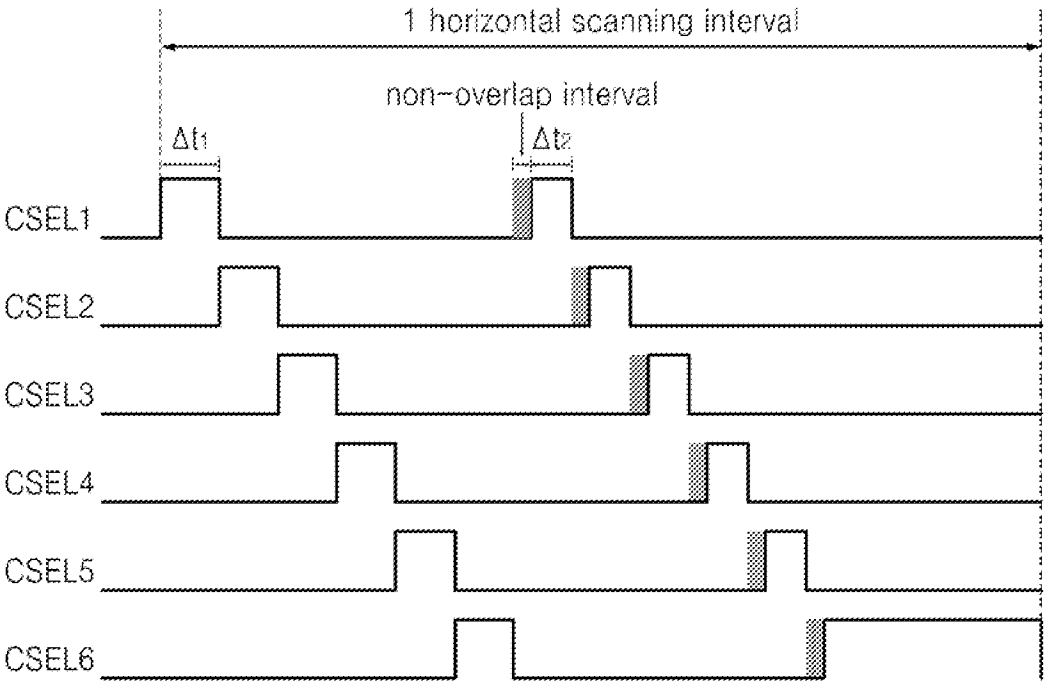
FIG. 3 is a timing diagram of channel select signals according to an exemplary embodiment of the present invention.

FIG. 3 is a timing diagram of channel selection signals according to an exemplary embodiment of the present invention. As described above, each analog voltage corresponding to a data image may be supplied to each data line multiple times during a horizontal scanning interval. In FIG. 3, it is illustrated that an analog voltage is supplied twice in a horizontal scanning interval and is supplied to six channels by a source driver.

Referring to FIGS. 1 to 3, a parasitic capacitor $C_{DL}$ of each data line S1, S2, . . . , Sm is charged by using an analog voltage supplied in a first activation interval $^{\Delta}$t1, and a voltage of a pixel capacitor Cps is approximated to a voltage of a parasitic capacitor $C_{DL}$ through charge sharing between a parasitic capacitor $C_{DL}$ of a data line and a pixel capacitor Cps in a deactivation interval which is a period before a next supply of an analog voltage. Next, by a supply of an analog voltage to each data line again in a second activation interval $^{\Delta}$t2, a voltage of a pixel capacitor Cps may get to a target voltage of each pixel quickly and accurately.

According to an exemplary embodiment, the second activation interval $^{\Delta}$t2 may be different from the first activation interval $^{\Delta}$t1. As described above, after charge-sharing between a parasitic capacitor $C_{DL}$ and a pixel capacitor Cps, the second activation interval may be shorter than the first activation interval since a voltage of a pixel capacitor may get to a target voltage only with a supply of an analog voltage for a short time.

In addition, the source driver 10 may control the plurality of switches SW1, SW2, . . . SWm to secure non-overlap interval for minimizing voltage noise, which may occur during a settling operation of the buffer 11. For example, the channel selection signal CSEL1, CSEL2, . . . CSELm may further include a non-overlap interval. Additionally, the non-overlap interval may be prior to the second activation interval.

For example, when a first channel selection signal CSEL1 is transitioned from a high level to a low level, the first channel selection signal CSEL1 may have a constant settling time. During such a settling time of a first channel selection signal, when a second channel selection signal CSEL2 is transitioned from a low level to a high level and an analog voltage is supplied to a second data line, e.g., S2, from a buffer 11, a voltage of the first data line may affect the second data line as a noise, which may cause a voltage error.

Accordingly, to solve such a problem, by starting a level transition of a channel selection signal controlling an analog voltage supplied to a next data line after a level transition of a channel selection signal controlling an analog voltage supplied to a prior data line is completely finished, a voltage error of a pixel capacitor may be minimized.

Figure 4:
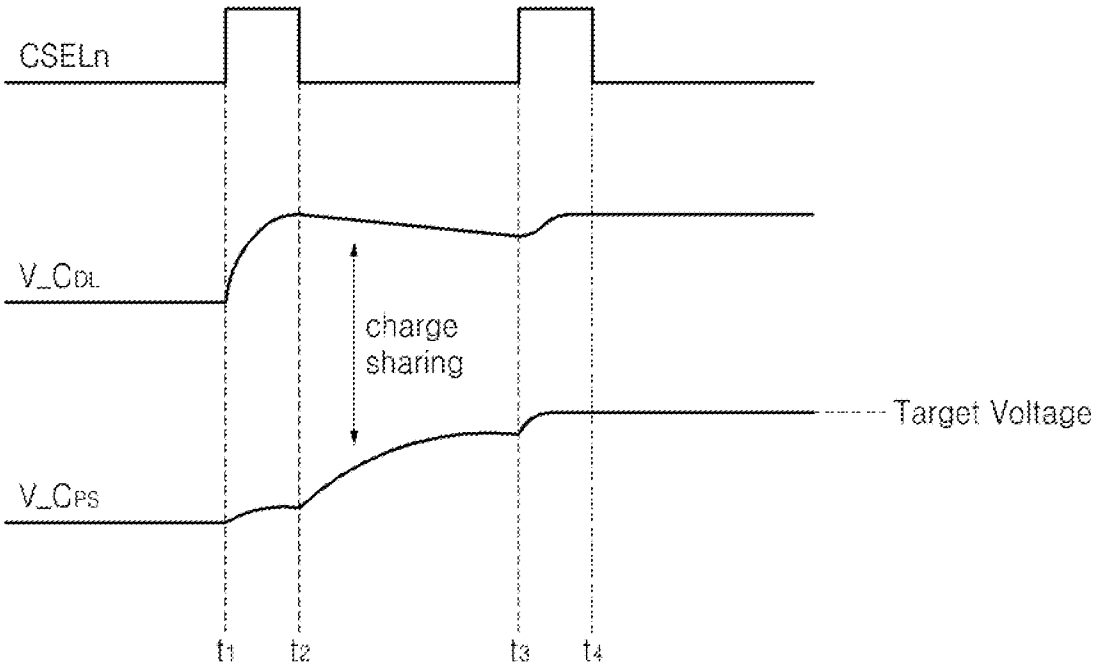
FIG. 4 is a timing diagram showing a parasitic capacitor of a data line and a voltage change of a pixel capacitor according to the timing diagram illustrated in FIG. 3.

FIG. 4 is a timing diagram showing changes in a voltage V_$C_{DL}$ of a parasitic capacitor $C_{DL}$ of a data line and in a voltage V_Cps of a pixel capacitor Cps according to the timing diagram of FIG. 3.

As described above, at a time point t1, when an analog voltage is supplied to each data line first, most of the voltage is charged to a parasitic capacitor $C_{DL}$ of a data line and only a small amount of voltage may be charged to a pixel capacitor Cps. During a pause interval between when a supply of an analog voltage is stopped at a time point T2 and when a next analog voltage is supplied again, charge sharing between a parasitic capacitor $C_{DL}$ of a data line and a pixel capacitor Cps may occur.

Therefore, at a time point of t3 when a second supply of an analog voltage begins, a voltage of a pixel capacitor Cps is already approximately equal to a target voltage, so that it may get to a target voltage quickly and accurately by a second supply of an analog voltage for a short time. According to an exemplary embodiment of the present invention, a second supply time of an analog voltage may be shorter than or equal to a first supply time of an analog voltage.

Figure 5:
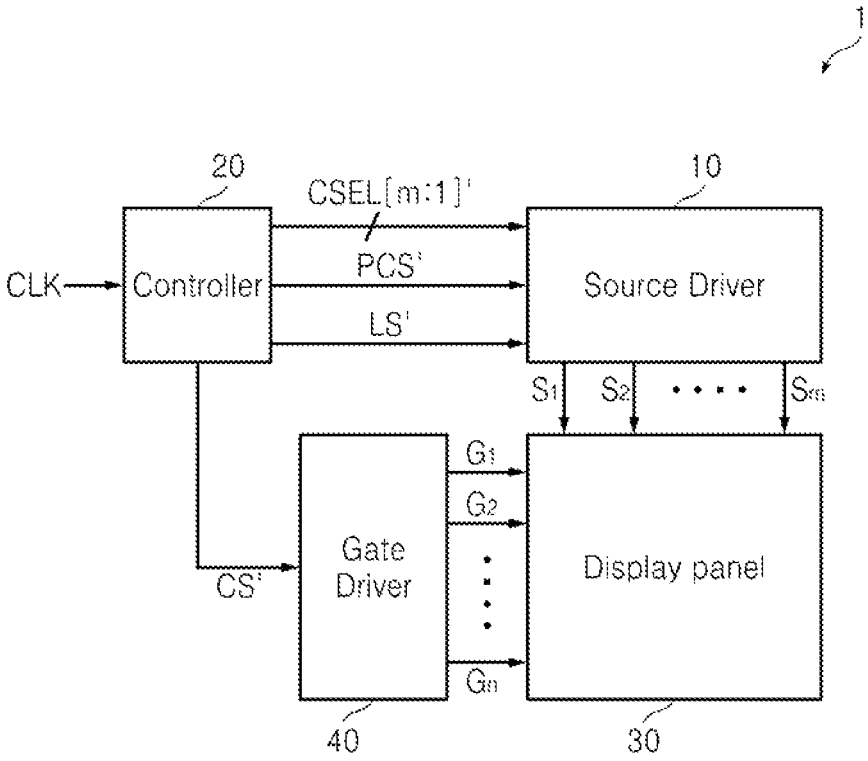
FIG. 5 is a block diagram of a display device according to an exemplary embodiment of the present invention.

FIG. 5 is a block diagram of a display device according to an exemplary embodiment of the present invention. Referring to FIGS. 2 and 5, the display device 1 may include a source driver 10, a controller 20, and a display panel 30. The controller 20 may generate a plurality of control signals PCS' and LS' and a plurality of channel selection signals CSEL[m:1]' in response to a clock signal CLK so that analog voltages output from a source driver 10 may be supplied to one of a plurality of data lines. Moreover, the controller 20 may output control signals CS', e.g., a gate clock signal or a gate on enable signal, for driving a gate driver 40 in response to the clock signal CLK.

As described above, signals CSEL[m:1]', PCS' and LS' output from the controller 20 are re-generated in a logic gate included in the source driver 10, and the re-generated signals CSEL[m:1], PCS and LS may be used in data selection, a polarity control, latching, a switching control, and so on as illustrated in FIG. 2. The display panel 30 may include a plurality of data lines S1 to Sm, a plurality of gate lines G1 to Gn, and a plurality of pixels formed at a crossover point of the data lines and the gate lines.

The gate driver 40 may control a gate of a pixel so that an analog voltage output from the source driver 10 may be supplied to each pixel. Each pixel of the display panel 30 may be turned ON/OFF by a transistor and turning ON/OFF of the transistor may be adjusted by the gate driver 40.

A source driver according to an exemplary embodiment of the present invention may lead to miniaturization of whole circuit by sharing several outputs using a DAC by a time division method. It may also secure maximum driving time of each pixel by supplying a voltage to each data line multiple times and minimize an error of a voltage charged to each pixel.

Although several exemplary embodiments of the present general inventive concept have been shown and described, it will be appreciated by those skilled in the art that changes may be made in these exemplary embodiments without departing from the principles and spirit of the general inventive concept.

What is claimed is:

1. A source driver for a display device comprising:

a buffer for buffering an analog voltage corresponding to digital image data; and a switching circuit, connected between an output terminal of the buffer and a data line, for supplying an output voltage from the buffer to the data line multiple times during a horizontal scanning interval of the display device in response to a control signal, wherein the supplying of the output voltage from the buffer to the data line multiple times includes:

a first activation interval in which a parasitic capacitor of the data line is charged with the output voltage;

a second activation interval, occurring after the first activation interval, in which a pixel capacitor of the data line is charged with the output voltage; and a deactivation interval, between the first activation interval and the second activation interval, in which charge sharing occurs between the parasitic capacitor and the pixel capacitor.

2. The source driver of claim 1, further comprises a logic gate generating the control signal to supply the output voltage of the buffer to the data line multiple times during the horizontal scanning interval of the display device.

3. The source driver of claim 1, wherein the output voltage of the buffer is supplied to the data line twice in response to the control signal during the horizontal scanning interval of the display device.

4. The source driver of claim 1, wherein the first activation interval and the second activation interval are different from each other.

5. The source driver of claim 1, wherein the second activation interval is shorter than the first activation interval.

6. The source driver of claim 1, wherein the deactivation interval is a non-overlap interval for minimizing noise resulting from an analog voltage corresponding to another digital image data supplied to another data line.

7. A display device comprising:

a source driver;

a timing controller generating a control signal for controlling provision of an analog voltage corresponding to digital image data from the source driver to a selected data line of a plurality of data lines; and a display panel receiving the analog voltage from the source driver and displaying the image data, wherein the source driver comprises:

a buffer for buffering the analog voltage; and a switching circuit connected between an output terminal of the buffer and the selected data line for supplying an output voltage from the buffer to the selected data line multiple times during a horizontal scanning interval of the display device in response to a control signal, wherein the supplying of the output voltage from the buffer to the selected data line multiple times includes:

a first activation interval in which a parasitic capacitor of the selected data line is charged with the output voltage;

a second activation interval, occurring after the first activation interval, in which a pixel capacitor of the selected data line is charged with the output voltage; and a deactivation interval, between the first activation interval and the second activation interval, in which charge sharing occurs between the parasitic capacitor and the pixel capacitor.

8. The display device of claim 7, further comprises a logic gate generating the control signal to supply the output voltage of the buffer to the selected data line the multiple times during the horizontal scanning interval of the display device.

9. The display device of claim 7, wherein the output voltage of the buffer is supplied to the selected data line twice in response to the control signal during the horizontal scanning interval of the display device.

10. The display device of claim 7, wherein the first activation interval and the second activation interval are different from each other.

11. The source driver of claim 7, wherein the second activation interval is shorter than the first activation interval.

12. The source driver of claim 7, wherein the deactivation interval is a non-overlap interval for minimizing noise resulting from an analog voltage corresponding to another digital image data supplied to another data line of the plurality of data lines.

13. A display device comprising:

a display panel comprising a plurality of pixels;

a gate driver for controlling a gate of each of the plurality of pixels;

a controller for generating a control signal; and a source driver comprising:

a buffer for buffering an analog voltage corresponding to digital image data; and a switching circuit, connected between an output terminal of the buffer and a data line, for supplying an output voltage from the buffer to the data line multiple times during a horizontal scanning interval of the display device in response to the control signal, wherein the supplying of the output voltage from the buffer to the data line multiple times includes:

a first activation interval in which a parasitic capacitor of the data line is charged with the output voltage;

a second activation interval, occurring after the first activation interval, in which a pixel capacitor of the data line is charged with the output voltage; and a deactivation interval, between the first activation interval and the second activation interval, in which charge sharing occurs between the parasitic capacitor and the pixel capacitor.

14. The display device of claim 13, further comprising a logic gate generating the control signal to supply the output voltage of the buffer to the data line multiple times during the horizontal scanning interval of the display device.

15. The display device of claim 13, wherein the output voltage of the buffer is supplied to the data line twice in response to the control signal during the horizontal scanning interval of the display device.

16. The display device of claim 13, wherein the first activation interval and the second activation interval are different from each other.

17. The display device of claim 13, wherein the second activation interval is shorter than the first activation interval.

18. The display device of claim 13, wherein the deactivation interval is a non-overlap interval for minimizing noise resulting from an analog voltage corresponding to another digital image data supplied to another data line.

* * * * *